US006554448B2

(12) United States Patent
Carpenter et al.

(10) Patent No.: US 6,554,448 B2
(45) Date of Patent: Apr. 29, 2003

(54) LUMINARY DEVICE WITH THERMOCHROMATIC LABEL

(75) Inventors: M. Scott Carpenter, Racine, WI (US); Kara L. Kotary, Racine, WI (US)

(73) Assignee: S. C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 09/753,962

(22) Filed: Jan. 3, 2001

(65) Prior Publication Data

US 2001/0043469 A1 Nov. 22, 2001

Related U.S. Application Data

(63) Continuation-in-part of application No. 09/550,285, filed on Apr. 14, 2000.

(51) Int. Cl.[7] ..... F21V 19/00

(52) U.S. Cl. ..... 362/161; 362/84; 431/289

(58) Field of Search ..... 362/161, 806, 362/84; 431/126, 289, 288; 206/497; 428/34.9, 332, 339

(56) References Cited

U.S. PATENT DOCUMENTS

| | | | | |
|---|---|---|---|---|
| RE20,434 E | | 7/1937 | Barrett, Jr. | 67/21 |
| 2,137,707 A | | 11/1938 | Wade et al. | 67/21 |
| 3,126,682 A | | 3/1964 | Krance | 53/30 |
| 3,286,492 A | | 11/1966 | Frazier, Jr. | 67/21 |
| 3,586,473 A | | 6/1971 | Galloway | 431/126 |
| 3,829,348 A | | 8/1974 | Spiegel et al. | 161/16 |
| 4,028,118 A | | 6/1977 | Nakasuji et al. | 106/21 |
| 4,428,790 A | | 1/1984 | Diaz | 156/86 |
| 4,524,778 A | | 6/1985 | Brown, Jr. et al. | 128/736 |
| 4,720,301 A | | 1/1988 | Kito et al. | 106/21 |
| 4,725,462 A | * | 2/1988 | Kimura | 283/97 |
| 4,732,810 A | | 3/1988 | Kito et al. | 428/402.2 |
| 4,818,215 A | * | 4/1989 | Taga | 428/16 |
| 4,996,087 A | * | 2/1991 | Rebstock | 428/11 |
| 5,083,251 A | | 1/1992 | Parker | 362/255 |
| 5,223,003 A | * | 6/1993 | Tucholski et al. | 29/623.4 |
| 5,223,958 A | * | 6/1993 | Berry | 273/146 |
| 5,282,651 A | * | 2/1994 | Alonso | 283/117 |
| 5,482,373 A | | 1/1996 | Hutchinson | 374/141 |
| 5,879,496 A | * | 3/1999 | Bright et al. | 156/446 |
| 5,932,685 A | | 8/1999 | Mori et al. | 582/272 |
| 6,113,996 A | * | 9/2000 | Amon et al. | 428/317.9 |
| 6,165,234 A | | 12/2000 | Kanakkanatt | 44/275 |

FOREIGN PATENT DOCUMENTS

| | | |
|---|---|---|
| GB | 2 358 193 | 7/2001 |

* cited by examiner

*Primary Examiner*—Sandra O'Shea
*Assistant Examiner*—Hargobind S Sawhney

(57) ABSTRACT

A decorated luminary product includes either a candle or a candle holder containing the candle. A decorative web of a heat-shrinkable polymer web is heat shrunk to conform to a shape of the one of the candle and the candle holder. The web is decorated with a thermochromic ink or pigmentation to cooperate with heat emitted by burning the candle to provide a visible change in the ink or pigmentation, so as to provide a pleasing visual effect when the candle is burned.

14 Claims, 2 Drawing Sheets

LUMINARY DEVICE WITH THERMOCHROMATIC LABEL

RELATED APPLICATION

This is a Continuation-In-Part application of Ser. No. 09/550,285, filed Apr. 14, 2000.

FEDERALLY SPONSORED RESEARCH OR DEVELOPMENT

Not applicable.

BACKGROUND OF THE INVENTION

1. Technical Field

The present invention, in general, relates to decorated luminary products, and more particularly relates to candle products decorated by the application of a decorative film having temperature sensitive properties, either to the candles themselves, or to candle holders in which the candles are situated.

2. Background Information

Luminary products, such as candles and candle products come in many shapes, sizes, and designs. The terms "luminary, luminaries, and luminary products" shall be used herein in reference to combustible active material or fragrance delivery candles, or illumination devices which are wick based and burn a hydrocarbon-based fuel, such as candles, oil lamps or lanterns. For example, the invention is applicable to illuminating devices in which the source of illumination is a burning wick, consuming lamp oil, and enclosed within a conventional oil lamp having a glass chimney. Some candles are intended to stand alone, while others are intended to be held upright as candlesticks, or in lanterns, jars, and the like. Other candles are intended to be situated in candle holders, and in the case of so-called gel candles and some wax candles, commonly called jar candles, the candles may substantially fill the volume of the holders in which the candles are situated, or come to some desired level of filling of the holder. More-over, it is to be understood that when a luminary, or a candle or candle holder is referred to, it is intended to include not only candles, but other forms of luminary devices, such as oil lanterns and lamps and globes for such. Thus, it is to be noted that the present invention is not to be limited to candles, and such, but encompasses luminary devices having various substrates which are subject to temperature variation or modification such as may activate a thermochromatic wrap applied thereto, particularly those in which temperature variations result from radiant energy impinging upon the surface of the material to which a thermochromatic material is applied.

In many of these cases, it is desirable to decorate the luminary products to improve their aesthetics, for both when the luminary is displayed unlit, and for when lit. However, it can be difficult and costly to decorate the exterior surface of a luminary or its holder. Also, many known techniques do not provide flexibility in production to rapidly and easily change the particular decorative design. This limits the ability to provide cost-effectively a variety of designs, or to tailor the designs to the desires of the consumer, or to a specific season, event, motif, holiday or the like, or to provide a product having a decorative effect which changes in accordance with whether the luminary is itself lit or unlit.

Therefore, there is a need in the art for a cost-effective decorating method which permits greater flexibility in production to allow a change from among varied decorative designs, and provides a decorative luminary product which changes when the luminary itself is burning.

It has long been known to encase candles in protective material. For example, U.S. Pat. No. 2,137,707, of Wade, et al., relates to a process for packaging tapered candles in a seamless casing formed of a non-fibrous, cellulosic material. The casing may be transparent, translucent and/or colored. In one embodiment, the non-fibrous, cellulosic material is formed into a tube, which is wetted to soften the material for application to the candle. The diameter of the wet tube is substantially equal to the mean diameter of the tapered candle, and as the wet tube is pushed down onto the candle, or a mandrel having the same dimensions as the candle, it stretches as necessary to fit over the wider end of the candle. Then, the covered candle is dried, and the tube forms a protective casing that conforms closely to the shape of the candle, and will retain the candle wax whether in a solid or melted state.

It has also been known to wrap candles in heat-shrinkable films for shipping and display. In U.S. Pat. No. 3,126,682, Krance teaches a method of wrapping candles. A tube of heat-shrinkable film material is loosely formed about the candle by shaping a web of the material about the candle with overlapping longitudinal edges. By grasping the tube just beyond each end of the candle, the wrapped candle is carried past a heat source, by which the material is heat shrunk around the candle. The material selected has two important characteristics: it will not shrink any further once it contacts the surface of the candle, and it holds a high charge of static electricity which causes it to cling when overlapped. Thus, the material is not heat sealed, but rather is held together statically around the candle after shrinking to a tight fit.

It has also been known to apply heat-shrinkable wraps on various objects for decorative purposes. For example, U.S. Pat. No. 3,829,348, of Spiegel et al., relates to decorating three-dimensional objects such as ornaments, glassware, or electric bulbs. The object is decorated by heat-shrinking a decorated tube or band of heat-shrinkable plastic about the object. The tube or band is decorated by applying precut patterns, silk screening, striping or the like, prior to application of the tube or band to the object to be decorated. The plastic is preferably polyvinyl chloride (PVC) or polyethylene, which is uniaxially oriented, resulting in a 30–50% diametric shrinkage versus only a 2–10% height shrinkage of the tube, resulting in an intimate contact of the entire interior surface of the band or tube with the exterior surface of the decorated object.

Similarly, US Reissue Patent RE. 20,434, of Barrett, Jr., teaches the preparation of a sanctuary candle, wherein the body of the candle is tightly jacketed in a cylindrical transparent film of amorphous cellulose, fitted to the candle while still un-dried. It is taught that the film may be either clear or colored, and may be combined with a colored glass tube forming the outside of the assembly, which includes a bottom assembly and a cap.

In co-pending patent application 09/550,285, filed Apr. 14, 2000, of which this is a Continuation-In-Part application, Kotary et al. disclose a technique for the application of a shrink-wrap decorative film to a candle for the purpose of providing a cost-effective and flexible method for providing a variety of decorative effects upon candle products. That co-pending application is directed specifically to methods of application of shrink-wrap films to a candle product, and the products obtained by such methods, with little discussion of specific visual effects attainable therewith.

The present invention relates to luminary products which change, or evolve, as the flame of the luminary element burns. Thus, as the interior of the candle holder, chimney, globe, jar, or other surrounding surface upon which a thermochromatic design or indicia is drawn, imprinted, or otherwise applied, is heated by the flame of the candle or burning element, the surface design changes as a result. Specifically, the present invention relates to candles or other luminary devices having a holder, chimney, globe, jar, etc. associated therewith, wherein there is applied to the surface of said holder, chimney, jar, etc., a shrink wrap film upon which a design or indicia has been printed, painted, or otherwise applied, employing an ink or paint having thermal sensitivity, whereby the ink or paint may change color, become visible, or become invisible as a result of heat. The design or indicia may be applied as the sole layer of decoration of the shrink wrap film, or may be part of a more complex label in which a number of layers of imprinted, drawn, or otherwise applied indicia or designs are present, using normal ink or paint in conjunction with the thermochromatic ink or paint, or using only the thermochromatic ink or paint. For example, the shrink wrap, prior to application to the exterior surface of a candle jar, may be printed with a background layer, or a single design or pattern of conventional ink suitable for use as a decorative candle label, and a second, thermochromatic pattern may be applied over the first, in registry therewith so as to produce a desired pattern, to provide a specific effect upon heating of the label by the burning of the candle within the holder, chimney, jar, etc.

Thermochromatic inks and paints are known, but none have been employed in the manner suggested herein. In U.S. Pat. No. 3,286,492, Frazier teaches the application of a film to a candle surface, wherein the film provides a message or other indicia positioned so as to be invisible prior to lighting of the candle, but which becomes visible after the candle has been lit. In this reference, a holder is used to position the film between the candle and the holder, which has a wall of translucent material which hides the strip from view prior to lighting of the candle. After the candle has been lit, and the paraffin melted and liquified, the light from the burning wick shows through the translucent wall of the holder and the transparent portions of the strip. Thus, the indicia which becomes visible after lighting the candle is not thermochromatic in nature, but merely translucent or transparent, whereas the remainder of the film is opaque or translucent, so that the flame provides light which is transmitted through the liquified paraffin of the candle to reveal the printed indicia. A thin coating of dye may be applied to the inside surface of the film, so that the light passing through the transparent portion is colored. The film itself is said to be a photographic film, preferably a polyester base film which is substantially non-shrinking during development, and non-curling during heating.

Galloway, in U.S. Pat. No. 3,586,473, teaches a candle having a higher melting outer coating into which is incorporated a material which when exposed to the heat of the flame, yields a flame of a desired color. In this situation, the flame of the burning candle forms a cup like depression, surrounded by a higher melting outer coat resin, plastic, or other material, into which a chromogenic material is incorporated. The rim of the cup like depression is on the boundary of the flame, whereby it is raised to a far higher temperature than temperatures obtained at the wick or in the pool of liquified wax. The flame is then colored by passage of the light thereof through the highly heated chromogenic agents at the boundary of the flame. The patent makes no mention of printing a pattern, or any design, on the outer surface, and makes no claim that the nature of the color-producing material is new. What is claimed to be novel is the position of the color-producing material in the candle.

Nakasuji et al, Kito et al, and Kito et al, U.S. Pat. Nos. 4,028,118, 4,720,301, and 4,732,810, respectively, all teach reversible, temperature indicating compositions which provide a wide range of hues and function over a broad temperature range. However, none of the references suggests application of such inks to a shrink wrap label to be applied to a surface which is heated by an internally positioned candle flame.

Additional temperature indicating devices are taught by Hutchinson, and by Brown, Jr., et al, in U.S. Pat. No. 4,524,778, which discloses a thermographic indicator overlay, which may be positioned on the human body, to assist in the detection of malignant tumors by indication of areas of temperature difference. In Hutchinson, U.S. Pat. No. 5,482,373, a thermochromatic temperature indicator is taught which may be secured to the exterior of a beverage container, either magnetically or by adhesive means.

Taga, in U.S. Pat. No. 4,818,215, discloses a candleholder having an improved ornamentation effect. The candleholder comprises a hollow shell, shaped in the form of an animal, building, fruit, etc., which is heated by a candle positioned in its internal cavity. At least a portion of the external surface of the hollow shell is covered with a thermally responsive, color changing material, such as taught in the previously cited Nakasuji et al patent. When the candle is burned, the shell is heated, and the pattern seen is changed. The thermally sensitive material is applied directly to the shell by painting, printing, etc.

In U.S. Pat. No. 6,165,234, Kanakkanatt teaches a candle with an effect of color change with the use of positive and negative types of thermochromic dyes which develop dense color on heating to the melting point of wax. These candles are composed of mixture comprising compounds selected from an electron donating chromogenic organic compound, an electron accepting aromatic organic compound, a medium selected from aliphatic alcohols or paraffinic waxes, one or more of oil-based fragrances containing aromatic aldehydes, ketones, or esters, and soluble halides or nitrates of transition metals. By controlling the relative proportions and the physical proximity of the ingredients in a candle or candle wax or other waxes, as well as the specific thermochromic compound selected, a color may develop from a colorless state giving a positive thermochromic effect, or the initial color may be erased giving a negative thermochromic effect, on heating or when the candle bums. These color changing waxes and candles made therefrom may also transform from one color shade to another color shade when mixed with conventional oil-based dyes to give a color-to-color effect on heating or melting the wax as the candle burns.

In addition to the previously cited patents relevant to application of shrink wrap materials to surfaces, there are any number of references which teach the application of decorative and/or identifying materials, such as labels, to the exterior surfaces of various items. For example, Bright et al., in U.S. Pat. No. 5,879,496, teach a method for labeling convex surfaces, such as bottles, eggs, Christmas tree ornaments, and the like, by attachment of both ends of a segment of heat shrinkable material to the surface with an adhesive, followed by heat shrinking the major portion of the segment to a tight adherence to the surface. Conventional heat-shrink materials are employed, having a high degree of orientation of shrinkage. Heat shrinkable polyester films having particularly favorable shrink characteristics are taught by Mori et al, U.S. Pat. No. 5,932,685. The shrink-wrap films of this reference are said to be preferable due to the fact that not only do they undergo relatively little longitudinal sinking when shrunk, but that they also have very few wrinkles, shrinkage spots, or strains remaining after shrinkage.

Thus, there are a number of teachings of films suitable for shrink wrap application to an object for decorative purposes, but none which teach the shrink wrap application of a label bearing a design, print, or indicia which is responsive to light from a candle or similar flame, in that the design, print, or indicia is "changed" by the heat of the candle or flame during burning, and effectively alters the design as a result of temperature sensitivity. Thermosensitive or thermochromatic inks are known, and have been applied to various surfaces in the past, for decorative and for safety-illumination purposes. However, none have been suggested as suitable for shrink-wrap application to a substrate to be lit by a candle for subsequent change to a different color or such.

Further, high transparency of the shrink wrap label is desirable, to allow background lighting to show through, such as when applied to the outer surface of a candle holder, so that light from the burning candle will show through the film, while the printed area of the film simultaneously absorbs light from the candle, and subsequently changes as heat is absorbed from the candle, to provide a striking visual effect. None of the previously discussed references provide such an effect.

Thus, it has not previously been proposed to decorate a luminary product such as a candle or a candle holder with a heat-shrinkable film having properties such that the film bears a design or pattern which changes or evolves during the burning of the candle and after the candle is extinguished. The product thus is visually pleasing not only during burning, but when displayed unlit, it bears a visually pleasing pattern. It is to be noted that the thermochromatic materials used in the present invention may be "changed" not only by the heat of the candle light when the candle is lit, but by heat from other sources when the candle is unlit but in an environment where the temperature is above normal room temperature. Thus, the decorative candle of this invention will appear to change while sitting unlit on a table in proximity to a burning fireplace, for example, even after the candle is extinguished. In summary, it has not been previously suggested to decorate a candle or candle holder, jar, globe, or chimney, which will be subject to elevated temperatures during normal use, by application of a heat-shrinkable film having such properties as color changing as a result of elevation of temperature. The known art does not suggest such an application, nor does it suggest with any certainty that heat-shrinkable polymers could be used to decorate such a combustible product with the desired result.

SUMMARY OF THE INVENTION

The present invention addresses the foregoing by providing a product and method in which a luminary product is decorated by enveloping the luminary, candle, or holder, in a decorative, heat-shrinkable polymer wrap having the specified properties, and heat-shrinking the wrap about the luminary, candle, or candle holder.

The novel luminaries obtained by the practice of this invention produce visual effects which are inexpensive, visually pleasing, change with the duration of the burning of the candle, and are capable of being provided with a large variety of designs, such as with seasonal or holiday themes.

In one aspect, the present invention relates to a method of decorating a candle product, and includes the steps of providing a web of a heat-shrinkable polymer having a specific decorative feature, and encasing with the web a luminary product. After the encasing step, the web is heated to shrink the web to conform to a shape of the luminary product. In a case in which the luminary product comprises a candle holder, a candle may be inserted into the candle holder to enhance and enable the effect of the polymeric wrap employed. Thus, in one aspect, the present invention relates to a decorated candle product including a candle and a candle holder containing the candle. A decorative web of a heat-shrinkable polymer web having a pattern printed thereupon, said pattern being at least partially comprised of a thermochromic or thermochromatic material, is heat shrunk to conform to the shape of the candle or the candle holder. The web thus has a decorative feature, i.e. a pattern printed in a thermochromatic or color changing paint or ink, which feature cooperates with light and heat emitted by the candle to enable the visual effect created when the candle is burned. While the following description is written primarily in terms of application of a web to a candle holder, the present invention is also applicable to the application of a web directly to the outer surface of a candle per se. As an example, pillar candles may be wrapped with a web having a decorative feature, particularly where the diameter of the pillar candle is sufficient that the walls of the pillar candle remain thick enough to prevent softening or melting of the outer surface of the candle as the flame consumes the central portion of the candle, but not so thick as to prevent elevating the temperature of the outer surface. Another example of a candle having a wrap applied in accordance with the present invention would be a pillar candle having a centrally located candle holder in the "bore" of the candle, said holder being suitable for containing and burning a smaller candle, such as a votive candle or tea light. In such instances, the flame at the wick of the candle will illuminate and heat the outer surface of the candle from within, and activate the color changing ink on the decorative wrap, which will then appear to be of a different color after the candle has been burned for some period of time, and will fade to the original color when the candle is extinguished.

These and other aspects, objects, features, and advantages will be more evident from the following description and drawings, in which like reference numerals relate to like elements throughout.

DETAILED DESCRIPTION OF THE PREFERRED EMBODIMENTS

Figure 1A:
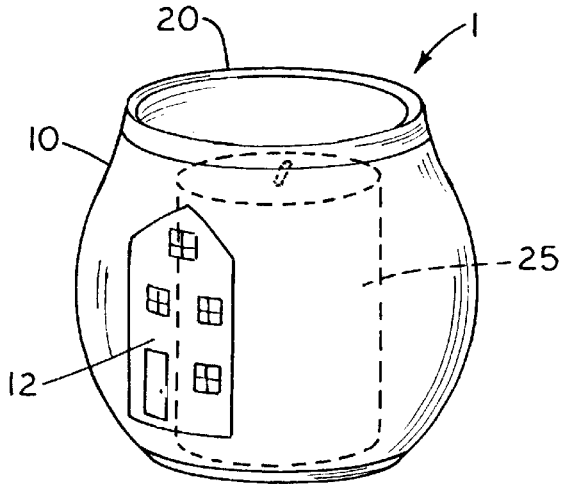
FIG. 1A is a perspective view of a decorated luminary product according to one embodiment of the present invention.

Various embodiments of a decorated luminary product may formed in accordance with the present invention. In each embodiment, the luminary product is decorated by enveloping an exterior surface in a decorative, heat-shrinkable polymer wrap and heat-shrinking the wrap about the surface to cause it to adhere tightly thereto. While it is possible to cause the decorative wrap of the invention to adhere to the candle product by other means, the preferred means comprise heat shrinking a heat shrinkable film to an adherent condition upon a surface. However, as will be evident to one skilled in the art, the decorative films used in the present decorated luminary device may be applied by such alternative means as attachment with holding devices such as staples, pins, tape, etc., particularly when being attached to candles per se.

As previously indicated, the basic concept of the present invention is the provision of a decorative color changing printed item upon a luminary product. The luminary product may comprise a candle, a lamp, or a holder or container for a candle or lamp. For example, the present invention is inclusive of candles having a decorative film on the outer surface thereof, a candle holder having a decorative film on either the inner or outer surface thereof, or a lamp chimney or globe having a decorative film on either the inner or outer surface thereof. As examples of the invention, Applicants believe that decorative candles, in the form of candle sticks, jar candles, or votive candles which either bear a decorative film upon the surface thereof, or are placed within a container, such as a glass jar decorated as taught hereinafter, fall within the scope of the present invention, as well as various configurations of globes or lantern chimneys, usually made of glass, designed to surround, enclose, encompass, retain, or hold candles of various shapes, oil burning lamps or various wicks which burn carbon-based fuel, which globes or lantern chimneys bear upon their surfaces a decorative film in accordance with the teachings of this disclosure. While the use of transparent globes, chimneys, or candle containers (such as jars) is preferred, it is possible to utilize opaque or translucent materials as well, although the visual effect is usually not as pronounced in such a case.

The present invention is particularly applicable to candles, candle holders, oil lamps, and the like which dispense an active material. Such active materials are well known in the prior art, and may be selected from the group consisting of fragrances, air fresheners, deodorizers, odor eliminators, malodor counteractants, insecticides, insect repellants, medicinal substances, disinfectants, sanitizers, mood enhancers, aroma therapy compositions, and mixtures thereof. The choice of specific active materials present in the luminaries of the present invention, if any, are within the skill of a practitioner of the art to which the present invention applies. However, preferred active materials which may be included in the wax of a candle, or in the oil of an oil burning lamp, include fragrances, insect repellants, insecticides, and deodorizers. Such active materials may be added, in liquid or gel form, to the fuel element of a candle or lamp to be dispersed to the atmosphere upon burning of the fuel. The present invention is of particular value in the preparation of luminaries including a candle comprising a mood enhancing or aroma therapy additive, said candle being surrounded by a globe, chimney, or container decorated with a pattern comprising a thermochromic ink.

Thus, the invention broadly encompasses a luminary product having a decorative changing label or film associated with it, in a position such that the thermochromic ink may be illuminated and heated by the flame of the luminary product when lit, and react thermochromatically so as to change before the viewer when the flame is burning, and possibly, after the flame is extinguished. The thermochromic ink may also absorb heat energy from ambient atmosphere when the flame of the luminary is unlit. The thermochromic feature is provided by means of a heat shrink film bearing said ink, said film being preferably adhered to the outer surface of the luminary product in such a manner as to be illuminated and heated by the flame thereof, or alternatively, heated by the ambient atmosphere when the luminary flame is unlit. The label changes color after the burning element is lit, and if a reversible thermochromic ink is employed, after the flame is extinguished, and when the ambient temperature level is above below the level of activation of the ink employed. It is to be understood that the heat energy necessary to excite or change the thermochromic material utilized in the present invention includes not only ambient heat, including heat from external sources such as furnace heating, proximity to a fireplace in a home, or sunlight, but also specifically includes the heat released by a flame burning at the wick of a candle, or on the wick of an oil lamp, or other such sources. The labels employed are applied by heat shrink techniques to substrates such as candles, candle jars, globes, votive jars, and chimneys, to provide a highly decorative luminary product. The preferred methods for the application of such films to a luminary product are set forth in copending U.S. patent application Ser. No. 09/550,285, filed Apr. 14, 2000, incorporated herein by reference.

The thermochromic inks may be any suitable inks for imprinting upon a shrink-wrap label of the type employed in said copending U.S. patent application Ser. No. 09/550,285. Exemplary of such inks and pigmentations are those disclosed by any of the previously cited references, provided that the specific ink or pigmentation selected is compatible with the shrink wrap film to which it is to be applied, compatible with any non-thermochromic or phosphorescent inks to be utilized in conjunction therewith, and are capable of exhibiting a thermochromic response to the heat of a burning luminary at the distance at which the shrink wrap label shall be positioned from the flame of the burning luminary. The thermochromic response to the heat may take the form of a change in color, a change from colored to transparent and colorless, or a change from transparent and colorless to colored. Essentially any thermochromic change visible to the eye may be of interest with respect to use in the present invention, particularly those which are reversible.

Figure 1B:
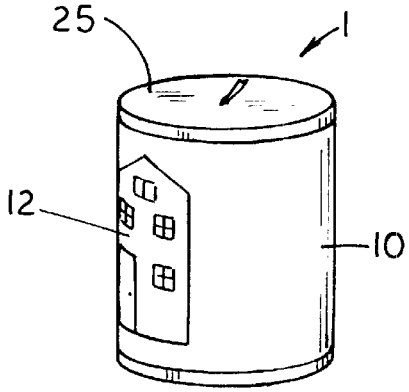
FIG. 1B is a perspective view of a decorated luminary product according to another embodiment of the present invention.

FIGS. 1A and 1B illustrate two embodiments of a decorated luminary product 1 formed in accordance with the present invention. In each embodiment, the luminary product 1 is decorated by enveloping the exterior surface 1 in a decorative, heat-shrinkable polymer wrap 10 and heat-shrinking the wrap 10 about the candle product 1. As shown in FIG. 1A, the wrap 10 can be heat shrunk to a candle holder 20 in which a candle 25 is carried. Alternatively, as shown in FIG. 1B, the wrap 10 can be heat shrunk directly to the candle 25.

The wrap 10 is a polymeric material having properties such as to provide the desired properties of the present invention. That is, the wrap constitutes a film upon which is deposited an image incorporating a thermochromic ink, either in a random manner, or in a desired pattern, which ink will be "changed" or radiantly heated by the incidence of light from a flame at the wick of the associated candle, and which will react in response thereto. As indicated, the thermochromic ink may take a pattern, such as a drawing, an image, a print indicia, or the like, or may be a totally random "splash" of coloration, either in a single color, or in a combination of colors.

For example, the wrap 10 may be provided with a design 12 that should not only improve the appearance of the candle 25 or holder 20, but should cooperate with light emitted by the candle 25 (for example, be illuminated by the light of the candle flame) to augment the visual effect created when the candle 25 is burning. For example, the base wrap 10 may be colored and translucent. This will augment any surface features (e.g., fillets, flutes or the like) of a candle holder 25 in a similar manner as would tinted glass. Alternatively, the wrap 10 may be selectively transparent, translucent and/or opaque to provide a desired light pattern when the candle 25 is lit. The design 12 can be provided by any of a number of suitable processes, such as printing (including using conventional inks throughout, or in selected areas) or finishing (including providing gloss, matte, or other specialty finishes). In the illustration shown in FIGS. 1A and 1B, an image of a house is printed upon a label, with the window areas printed in a thermochromic ink which changes from a dark color to yellow, or, alternatively, from transparent to yellow as the ink is heated. Thus, after the candle is lit and has burned a short time, the thermochromic ink will change color, causing the image of the house to appear to glow from within through the windows. As previously indicated, a preferred embodiment of the invention comprises a label having a clear film background with a colored design or indicia imprinted thereupon, applied to a transparent glass candle holder, in such a manner that the design or indicia is backlit by the flame of the candle during burning, and absorbs radiant energy from said flame while it burns. After a period of burning, and absorption of heat from the flame, the thermochromic ink in the printed design or indicia changes from transparent to a color, or changes color, showing the design or indicia in sharper contrast to the background, while other portions of the label, not printed in thermochromic inks, do not change. By printing the label with a plurality of colored thermochromic inks, either in single pass printing processes, or in multiple applications of different inks, complex multi-colored designs may be obtained, which will absorb light and heat from the candle while the candle burns, as well as from any ambient heat, and change color to provide a pattern of multiple colors, where there had previously been a transparent area or an area of limited coloration. For example, a candle wrap of the present invention may be printed in conventional manner with a design of a flower, with the leaves printed in a thermochromic ink which changes when heated from transparent to green, while a flower bud and petals may be printed in an ink which changes upon heating from transparent to red. After burning of the candle for a few minutes, the image of a flower is seen on the candle or candle jar, where previously it had not been visible.

In the embodiment illustrated in FIG. 1A, in which the wrap 10 is applied to the holder 20, the candle 25 disposed in the holder 20 can be formed of wax, gel or other suitable candle-forming material, and can be a pillar candle as shown, or may be a jar candle filling the holder 20 to a point below the top. Additionally, the candle 25 could be any combustible fragrance delivery or illumination device that is wick based and burns a hydrocarbon-based fuel, so that an active material may be released to the atmosphere during burning of the candle, and a changing image will show upon lighting of the candle.

There were initial concerns about whether heat-shrinkable polymers could be used to decorate such a combustible product. However, we have found that the preferred wrap material, poly(ethylene terephthalate) (PET), withstands the expected conditions (e.g., extended exposure to temperatures of up to about 150° F.) of use, and performs acceptably when exposed to such non-standard conditions as flare-ups (during which temperatures can approach about 600 to 800° F.), misaligned wraps, and the like. Although this material is preferred, the wrap material may be any of a number of suitable heat-shrinkable polymer films, including PVC, polyethylene, polystyrene, other polyesters, and the like, so long as the film is not adversely affected by the temperatures encountered during normal candle use. Further, if the wrap 10 is to be applied directly to the candle 25, we prefer that the wrap film be heat-shrinkable at sufficiently low temperatures or brief exposure times so that the candle 25 itself will experience little or no melting during the shrinking process. For the sake of convenience, the film application, or wrap, shall be described herein as application to a candle or to a candle holder, or simply a holder, it being understood that the terms "candle holder" and "holder" are intended to encompass all forms of globes, jars, chimneys, lamp exteriors, and enclosures suitable to surround a candle or lamp flame, through which the light of said flame would normally be observable.

Figure 3:
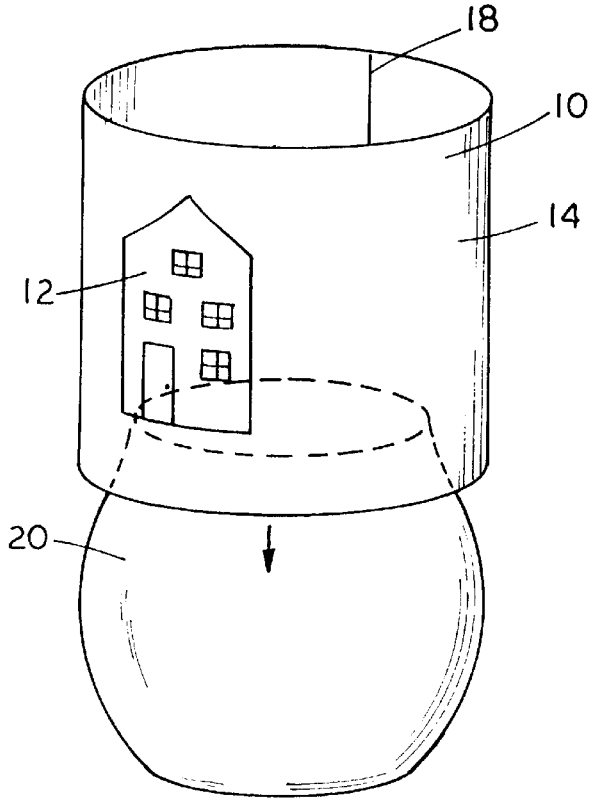
FIG. 3 is a perspective view illustrating a step in the product decorating method according to one embodiment of the present invention.
Figure 4:
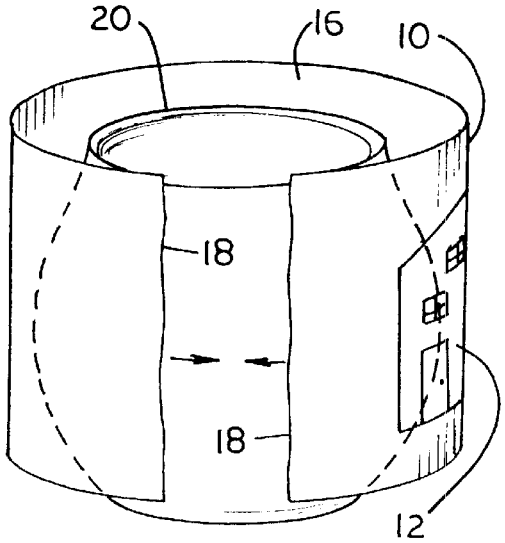
FIG. 4 is a perspective view illustrating a step in the product decorating method according to another embodiment of the present invention.
Figure 2B:
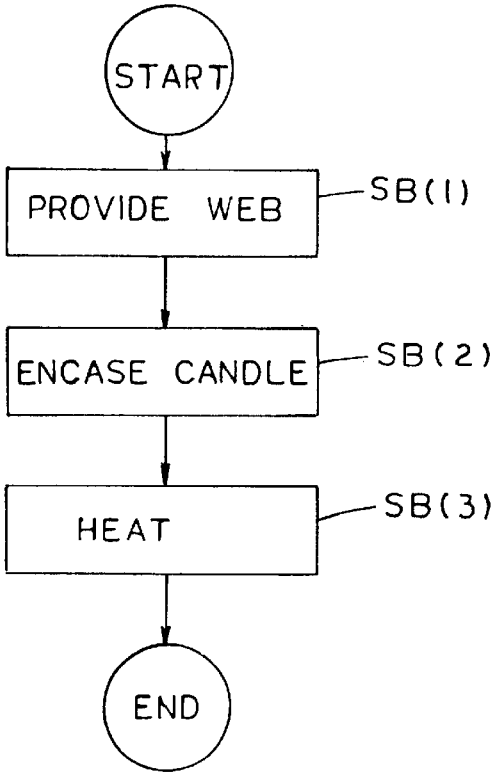
FIG. 2B is a flow chart illustrating a product decorating method according to another embodiment of the present invention.
Figure 2A:
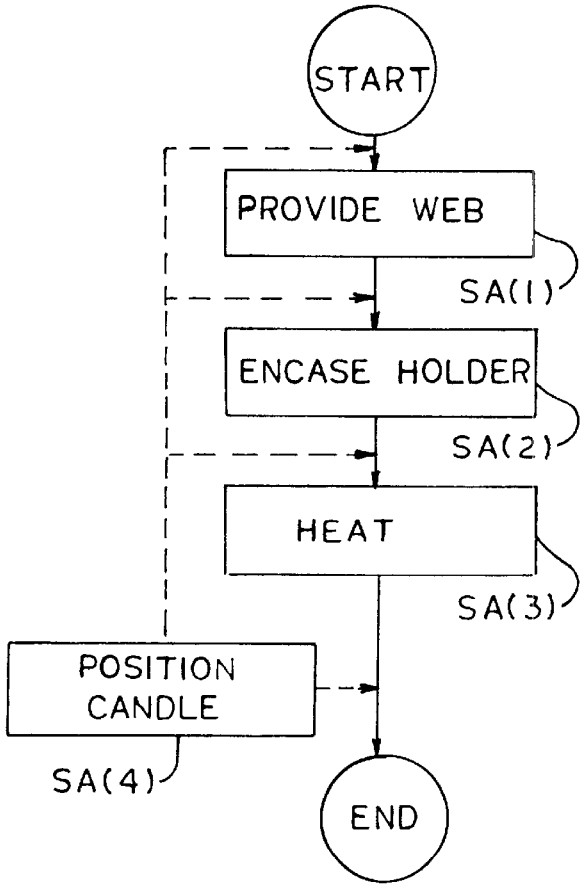
FIG. 2A is a flow chart illustrating a product decorating method according to one embodiment of the present invention.
Figure 5:
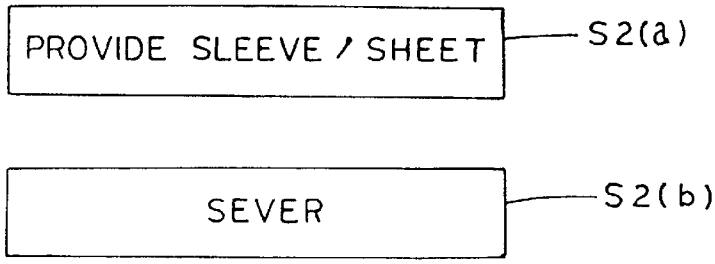
FIG. 5 is a flow chart illustrating in more detail a preferred embodiment of a step in a product decorating method according to one embodiment of the present invention.

Referring to FIGS. 2A and 2B, the decorating processes for the wrapped-holder and directly-wrapped-candle embodiments, respectively, each includes the step of providing a web of wrap film [steps SA(1) and SB(1)]. The design or pattern desired is printed, drawn, painted, or otherwise applied to the surface of the web prior to the web being affixed to the luminary product. Preferably, but not necessarily, the wrap film will be provided in individual pieces: preformed, closed loops or bands 14 that fit over a candle 25 or holder 20 (as shown in FIG. 3) or panels 16 that are wrapped about a candle 25 or holder 20 (as shown in FIG. 4). In each of these cases, as shown in FIG. 5, the step of providing the web [step SA(1) or SB(1)] can include the steps of providing a continuous sleeve or sheet [step S2(*a*)] and severing the sleeve or sheet into the individual pieces [step S2(*b*)]. Alternatively, the web can be cut into pieces later in the process, such as after the web encases the candle product 1 (as discussed hereinafter).

In any case, the edges 18 of the film are overlapped and seamed in a known manner, either before (in the case of bands 14) or after (in the case of panels 16) application to the candle holder 20 or candle 25. For example, the edges 18 may be solvent sealed, heat sealed, adhesively sealed, sonically welded, or the like. In the case of bands 14, the edges are joined at sleeve formation, which in a preferred embodiment is done by joining opposing transverse edges of a "continuous" web of the film by tetrahydrofuran (THF) solvent applied in a known manner. Also, the design 12 preferably will be applied to the film before it is severed into individual pieces. In the case of bands 14 (as shown in FIG. 3), the design 12 is preferably applied to the continuous web in advance of the sleeve formation, by printing, or by similar appropriate application means, using thermochromic inks. It is also possible for the design to comprise conventional, phosphorescent and glow-in-the-dark design elements, and thermochromic elements so that differing designs show in the presence and absence of either candle light and heat or ambient lighting and heat.

The film of the wrap 10 may be oriented so as to shrink predominantly in a single direction, thereby improving the predictability of the shrink-wrapping process. This can be accomplished in a known manner. For example, prior to formation of the individual pieces, while the film still comprises in a generally "continuous" web, the film can be heated and stretched in one direction. Usually this will be done in the cross-machine direction (transverse to the length of the continuous web). When the film is heated again later, in a heat-shrinking process, the film will shrink predominantly in the direction in which it has been stretched. Although not necessary to the invention, it would be preferable to orient the film so as to shrink about the candle product 1 to a much greater extent in the circumferential rather than axial direction. This facilitates orientation of the film relative to the candle 25 or holder 20. The not-yet-shrunk film can be placed loosely about the candle 25 or holder 20, and the top or bottom edge of the film can be aligned substantially with its intended final position. As the film shrinks (predominantly circumferentially), the film will close tightly about the candle 25 or holder 20 without undue axial displacement of the top and bottom edges of the film.

The preferred PET film is about 25 to about 60 microns thick and is oriented transversely so as to exhibit the following shrinkage characteristics when submersed in heated water for fifteen minutes:

| Water | Shrinkage (%) | |
|---|---|---|
| Temperature (? C.) | Machine direction | Cross-machine direction |
| 80 | <4 | 50–60 |
| 100 | <3 | >70 |

The individual bands 14 or panels 16 for application to each candle 25 or holder 20 can be produced by severing the continuous sleeve or sheet [step S2(*b*)] at a timing metered by the output of a photosensor. The photosensor can be employed to detect predetermined registration markers on the sleeve or web, in order to ensure that the sleeve or web is severed at appropriate intervals with respect to the design 12 on the film. (If desired, the photosensor detection "window" can be limited to specified time periods in a known manner). If the decorative design 12 is a repeating pattern, then the photosensor can key on a specific aspect of the pattern. If the design is not repeating or repeats less frequently than every cutting interval, then a standard registration marker can be provided. For example, a clear box with a specified border can be incorporated into each design 12 at the same location in the individual band 14 or panel 16. This permits a single web to bear more than one design 12, resulting in bands 14 or panels 16 that differ from one another in design. This greatly increases the ease and cost-effectiveness of producing candle products 1 decorated with varied designs, particularly bearing a plurality of thermochromic inks.

Returning to FIGS. 2A and 2B, in step SA(2) and SB(2), the holder 20 or candle 25 is encased by the heat-shrinkable wrap. (See FIGS. 3 and 4.) In the preferred embodiment, this is done with a band 14 or wrapped panel 16 that is slightly larger in circumference than the target candle 25 or holder 20. In the case of, for example, a candle holder 20 that is not cylindrical (i.e., it is wider in some places than others), the band 14 or wrapped panel 16 should be slightly larger in circumference than the widest part of the candle holder 20. This, however, is not always necessary, since the band 14 or panel 16 can be stretched onto a slightly larger candle holder 20 if desired.

The height of the band 14 or panel 16 can be very close to the desired height of the finished design on the candle 25 or holder 20. As noted, an oriented film can be used in known manner to provide a band 14 that shrinks predominately in the circumferential direction, with very limited shrinkage in the axial direction.

A typical band 14 will be described for application to a curved holder 20 that is approximately 68.6 mm tall and has a side wall that is approximately 70.6 mm in diameter at its mouth, bulges to approximately 80.8mm in diameter (approximately 253.8 mm in circumference) at its widest point, and tapers to approximately 40.5 mm in diameter at its base. The elongated sleeve, from which the bands 14 are formed, is approximately 260.75 mm in circumference (corresponding to approximately 83.0 mm in diameter). The sleeve is severed transversely into bands 14 that are approximately 71.0 mm in height. Thus, each band 14 is approximately 7.0 mm larger in circumference than the holder 20. Each band 14 is also approximately 2.4 mm taller than the holder 20. However, due to the rounded side wall of the holder 20, the actual distance along the side wall from top-to-bottom actually exceeds the height of the band 14 by a few millimeters.

The thus-formed band 14 is then placed over the candle holder 20 (see FIG. 3). At this stage of the process for wrapping a candle holder 20 (illustrated in FIG. 2A), it is preferred that no candle 25 be present, although this is not necessary to the invention. This permits the holder 20 to be oriented upside-down on a carrying surface (such as a conveyor belt or tray) for band application. This provides several advantages. In this orientation, the band 14 can rest against the carrying surface at the outset of heat-shrinking. This prevents the wrap 10 from overlapping the mouth of the holder 20. It also provides a reference surface to keep wrap 10 from skewing relative to the holder 20. A secondary advantage is that the absence of the candle 25 at this stage avoids subjecting candle 25 to the elevated temperatures of the heat-shrinking process, which could result in some softening or melting (although the melting can be kept to a minimum, as in the case of the application of the wrap 10 directly to a candle 25).

It should be noted that the candle 25 may be positioned in the holder 20 [step SA(4) in FIG. 2A] earlier in the process, and may be present before the wrap 10 is applied to the holder 20. For example, in the case of gel-candles or pour-in wax candles, the candle may be poured into the holder 20 at any point in the process, as shown by the dashed lines in FIG. 2A. In fact, it is possible that the candle may be at such a temperature when poured into the holder, that the candle itself can contribute to or achieve the heating step (discussed below).

In the case of application of a wrap 10 directly to a candle 25 (FIG. 2B), it is preferred to orient the candle 25 upright. This makes it easier to orient the wrap 10 so that it does not interfere with the wick. This also minimizes the effect on the wick of whatever small degree of melting that might occur during heat-shrinking.

Once the band 14 or panel 16 is positioned about the candle 25 or holder 20, the combination can be fed by any known mechanism (e.g., a conveyor belt) into a heating station, where the band 14 or panel 16 is heat shrunk onto the candle 25 or holder 20 [steps SA(3) and SB(3)]. The heating station can apply hot, dry air; hot, humid air or steam; or some sequential combination of hot air and steam. The sequential combination is preferred in order to best avoid wrinkles and bubbles in the finished wrap 10, in a manner well known in the art. However, it is to be noted that interesting and varying visual effects may be obtained by allowing the formation of wrinkles and bubbles in the wrap as applied to the substrate. For example, such irregularities add visual depth and variation to the product, and a three-dimensional effect is possible. In the case of a PET film having the above-noted thickness and shrinkage characteristics, formed into bands 14 having the above-noted dimensions, and having a design printed thereupon, the bands 14 are subjected to four consecutive stations of hot, dry air (about one to about two seconds each at a temperature of about 100 to about 400° F., preferably about 300 to about 400° F., depending on application), and then to a station of steam (about three to about five seconds at a pressure of about 5 to about 15 psi.)

The number, order, exposure time and intensity of the heating stations can be varied in a known manner according to the specific dimensions and characteristics of the wrap film and the candle or holder.

Once heat-shrinking is complete, the wrapped candle 25 or holder 20 may be dried if necessary by a conventional air blow-dryer or other known mechanism, at which point the candle 25 is ready for packaging, as is the holder 20 once the candle is positioned therein [step SA(4)].

EXAMPLE

A luminary product, comprising a small jar candle, having a decorative label attached to the exterior surface of the jar, was prepared in accordance with the methods set forth above. A label of poly(ethylene terephthalate) (PET) shrink wrap material was cut to fit ajar candle, such as illustrated in FIGS. 1A, 3, and 4, and sold under the trademark Glade® Candles, commercially available from S. C. Johnson & Son, Inc., of Racine, Wis. A design was printed on the label, using conventional ink, to provide a picture of a Christmas tree, having green branches, white garland, a gold star, and a brown trunk. Further elements were hand painted into the design of the tree, using thermochromic inks to provide decorations on the branches of the tree. Reversible thermally color-changing "balls" were painted on the tree, using pigments which changed from green to red, from clear to yellow, and from clear to white. The label was applied to the exterior surface of the jar candle in the manner set forth above, and shrunk to a tight fit thereupon. The unlit jar candle was observed, and the design was found to show a green tree having white garland and a yellow or gold star at the top thereof, with a brown trunk at the base thereof. After being lit, and after having burned for about 15 minutes, the candle was again observed. This time, the tree appeared as before, but with additional red, yellow, and white balls in the branches. After the candle was extinguished, and allowed to cool to room temperature, the balls faded away, leaving only the tree as originally observed.

Although the above-described process is preferred, alternative processes may be used. For example, alternative methods utilizing a preformed loop of film are described in the above-noted Spiegel, et al. patent (in which the loop fits loosely over the object before heat-shrinking). The disclosure of this patent is incorporated herein by reference. An alternative method utilizing a sheet that is wrapped around the object is described in U.S. Pat. No. 5,879,496 (Bright, et al.), the disclosure of which also is incorporated herein by reference in its entirety.

We have found that the present invention provides an additional advantage in that the shrink wrap, when applied, protects the candle holders, which are typically glass. Specifically, the shrink wrap maintains the integrity of and otherwise protects the glass during production or use from, for example, abrasion or scratching. Such scratches significantly reduce the integrity of the glass. Glass, once scratched, loses compression strength and becomes more fragile. The shrink wrap reduces the incidents of such abrasion or scratching, and preserves the integrity of the glass.

While the present invention has been described with respect to what is at present considered to be the preferred embodiments, it should be understood that the invention is not limited to the disclosed embodiments. To the contrary, the invention is intended to cover various modifications and equivalent arrangements, some of which are discussed above, included within the spirit and scope of the appended claims. Therefore, the scope of the following claims is intended to be accorded the broadest reasonable interpretation so as to encompass all such modifications and equivalent structures and functions.

INDUSTRIAL APPLICABILITY

The inventive luminary decorating method and product utilize heat-shrinkable films to provide a design that cooperates with the light and heat emitted by the luminary element to achieve a pleasing visual effect, greatly enhancing the aesthetics of the decorative items, by providing a thermochromic effect which causes a design printed upon the luminary or the holder to change color, or to change from transparent and colorless to colored (or vice versa), during the burning of the luminary. The method and product permit greater flexibility than known methods and products to allow a change, easily and cost-effectively, in production from among varied decorative designs.

We claim:

1. A luminary product having a decorative outer covering, said outer covering comprising a decorative web of a heat-shrinkable polymer which has been shrunk to conform to the external shape of said product, wherein said decorative web comprises a thermochromic material which reacts to heat, said luminary product comprises a candle, and said decorative web is adhered to said candle.

2. A luminary product of claim 1, wherein said decorative web comprises a heat shrinkable polymer having a design printed thereupon comprising a thermochromic ink.

3. A luminary product of claim 2, wherein said design comprises plural thermochromic inks which are activated by the light of said candle.

4. A luminary product of claim 2, wherein said design further comprises non-thermochromic inks.

5. A luminary product of claim 2, wherein said decorative web comprises a transparent polymeric web.

6. A luminary product having a decorative outer covering, said outer covering comprising a decorative heat-shrinkable polymer web which has been shrunk to conform to the external shape of said product, said web having a design printed thereupon comprising a thermochromic ink which reacts to heat, said luminary product comprising a candle and a candle holder, wherein said candle holder comprises a glass container for said candle, said web is adhered to said candle holder, and wherein said design further comprises a phosphorescent ink which is activated by ambient light and emits light when said candle is extinguished.

7. A luminary product of claim 6, said decorative outer covering comprising a polymeric film comprising a material which absorbs radiant energy from a burning flame and changes color as a result thereof, said luminary further comprising an active material.

8. A luminary product as set forth in claim 7, wherein said active material is selected from the group consisting of fragrances, air fresheners, deodorizers, odor eliminators, malodor counteractants, insecticides, insect repellants, medicinal substances, disinfectants, sanitizers, mood enhancers, aroma therapy compositions, and mixtures thereof.

9. A luminary product asset forth in claim 7, wherein said active material is selected from the group consisting of fragrances, insect repellants, insecticides, and deodorizers.

10. A luminary product as set forth in claim 9, wherein said product comprises a candle.

11. A luminary product as set forth in claim 9, wherein said product comprises a candle and a candle holder selected from the group consisting of jars, votive holders, globes, and chimneys, said polymeric film is adhered to said candle holder, and said film comprises a heat shrinkable polymer having a design printed thereupon comprising at least one thermochromic ink capable of being activated by the heat of burning said candle.

12. A method for decorating a luminary product comprising a candle and candle holder, said method comprising the steps of:

a) providing a heat-shrinkable polymer web having a design printed thereupon comprising at least one thermochromic ink capable of being activated by the heat of burning said candle, said web comprising a material which absorbs radiant energy from a burning flame and changes color as a result thereof;

b) encasing with the web a substrate selected from the group consisting of candles, candle jars, candle chimneys, candle holders, lanterns, globes, and votive holders; and c) after the encasing step, heating the web to cause the web to shrink to conform to the shape of said substrate;

wherein said substrate encompasses an active material selected from the group consisting of fragrances, insect repellants, insecticides, and deodorizers.

13. A method as set forth in claim 12, wherein the polymer is oriented poly(ethylene terephthalate), wherein the web is preformed into a sleeve with the orientation of the polymer being circumferential to the sleeve, said method further comprising the step of severing the sleeve substantially in the direction of the orientation of the polymer to form a band, and wherein the encasing step comprises positioning the band around a candle jar.

14. The method according to claim 13, wherein the web is approximately 50 microns thick.

* * * * *